US009719743B2

(12) United States Patent
Elftmann, Jr.

(10) Patent No.: US 9,719,743 B2
(45) Date of Patent: Aug. 1, 2017

(54) SEMI-AUTOMATIC RIFLE AMBIDEXTROUS PUSH TYPE SPEED SAFETY

(71) Applicant: Arthur J. Elftmann, Jr., Glendale, AZ (US)

(72) Inventor: Arthur J. Elftmann, Jr., Glendale, AZ (US)

( * ) Notice: Subject to any disclaimer, the term of this patent is extended or adjusted under 35 U.S.C. 154(b) by 0 days.

(21) Appl. No.: 14/955,431

(22) Filed: Dec. 1, 2015

(65) Prior Publication Data

US 2017/0153078 A1 Jun. 1, 2017

(51) Int. Cl.
*F41A 17/52* (2006.01)
*F41A 17/46* (2006.01)
*F41A 35/06* (2006.01)

(52) U.S. Cl.
CPC ..... *F41A 17/46* (2013.01); *F41A 35/06* (2013.01); *F41A 17/52* (2013.01)

(58) Field of Classification Search
CPC ..... F41A 17/46; F41A 35/06; F41A 17/30; F41A 17/32; F41A 17/42; F41A 17/56; F41A 17/62; F41A 17/64; F41A 17/70; F41A 17/74; F41A 17/80; F41A 17/52
USPC ..... 42/70.01, 70.04–70.08, 70.11; 89/125, 89/142, 148, 150
See application file for complete search history.

(56) References Cited

U.S. PATENT DOCUMENTS 2,453,683 A * 11/1948 Caldow ..... F41A 17/46 42/70.04
3,290,993 A * 12/1966 Irusta ..... F41A 19/33 89/140
3,577,827 A * 5/1971 Billett ..... F41A 17/56 89/145
3,842,526 A * 10/1974 Dixon ..... F41A 17/06 42/1.01
4,719,713 A * 1/1988 Hagle ..... F41A 17/46 42/1.01
6,141,896 A * 11/2000 Oberst ..... F41A 17/02 42/70.06
2002/0194764 A1* 12/2002 Beretta ..... F41A 17/02 42/70.11
2004/0020092 A1* 2/2004 Christensen ..... F41A 9/70 42/49.01
2004/0194615 A1* 10/2004 Gablowski ..... F41A 17/32 89/148
2013/0111796 A1* 5/2013 Dionne ..... F41A 17/00 42/70.11
2015/0330734 A1* 11/2015 Kolev ..... F41A 3/12 42/69.01

FOREIGN PATENT DOCUMENTS

CA 2379739 A1 * 1/2001 ..... F41A 17/02

* cited by examiner

*Primary Examiner* — John D Cooper
(74) *Attorney, Agent, or Firm* — Douglas W. Rudy

(57) ABSTRACT

A sliding safety device for use in AR-15 style and type of semi-automatic rifles is disclosed. The sliding safety device having cylindrical end portions is configured to prevent the discharge of semi-automatic rifle when the device is in a "safe" position. Additionally the invention includes the method of retrofitting the sliding safety device into the lower receiver of a semi-automatic style or type rifle after removal of the standard rotating safety selector device that has been in use since the inception of semi-automatic rifles of the AR-15 style or type.

19 Claims, 1 Drawing Sheet

SEMI-AUTOMATIC RIFLE AMBIDEXTROUS PUSH TYPE SPEED SAFETY

BACKGROUND OF THE INVENTION

Field of the Invention

This invention is a safety device for use in semi-automatic rifles such as an AR-15® ("AR-15" is a trademark of Colt Industries but is widely used generically in reference to semi-automatic rifles) style or type rifle. There are many types of semi-automatic rifles and this disclosure is intended to encompass semi-automatic rifles, sometimes incorrectly referred to as assault rifles, legally available to civilian consumers in the United States. The semi-automatic rifles referred to are lightweight, compact weapons that fire an intermediate power cartridge. A feature of the AR style rifles is that they have a lower receiver that is the heart or platform of the rifle. As it is the defining element of an AR style rifle the serial number of the rifle is engraved, cast, or stamped ("impressed") on the lower receivers of commercial civilian AR style rifles sold in the United States. The lower receiver of an AR style rifle has a pistol grip and the lower receiver also houses a magazine well, a hammer, a trigger, a trigger sear, a selective fire selector, and about two-dozen other necessary components to complete a workable AR lower receiver. The upper receiver of an AR style rifle is of modular design allowing a broad range of components to be attached to the AR style lower receiver.

When engaged, the sliding safety device as disclosed, is an aid in preventing the discharge of the semi-automatic rifle. Additionally the invention includes the method of retrofitting the device into the lower receiver of a semi-automatic style or type rifle. This invention is limited only to semi-automatic rifles such as, but not limited to, the AR-15 styles and types of semi-automatic rifles, and related style or type rifles. This style or type of rifle is widely cloned, copied and produced by many companies and is generically known as an "AR." In this specification the configuration of semi-automatic rifle is sometimes referred to as an "AR" meaning that the lower receiver of these semi-automatic rifles are based on the well-known AR-15 and AR-10 platform.

Description of Known Art

The applicant is aware of slide type safety selectors used in non-AR style rifles such as shotguns and bb guns. Such slide safety selectors have a configuration different from the configuration of the semi-automatic rifle disclosed herein. The slide type safety selector used in shotguns has a cross sectional configuration unlike the slide safety selector disclosed. Furthermore, the slide safety of a shotgun does not interface with the top of a trigger extension, as does the standard lever type selector in an AR or the slide safety selector disclosed here.

The applicant believes that since the inception of the assault rifle, primarily the AR-10 from 1955 and 1956, as originally designed by Eugene Stoner, no semi-automatic rifle had a sliding safety selector as disclosed. The AR-10 design of Stoner had a lever operated rotating selector so that firing options could be selected. The AR-10 lead to the AR-15 developed by Robert Fremont and Jim Sullivan. The AR-15 also used a rotating selector that was also a safety device. As licensed to Colt's Manufacturing Company in 1959, the AR-15 and similar style weapons in the "AR" platform continued, and to this day, continue to use the rotating safety selector or rotating selective fire apparatus design.

It is expected that a person of ordinary skill in the art of rifle design would be aware of the slide type safety devices used on shotguns. However no person of ordinary skill in the art or event the experts such as Eugene Stoner, or other gun designers, ever incorporated the slide type selector in an assault rifle.

A primary reason that the slide type safety selector was never incorporated in an assault rifle is because the assault rifle had it roots in military applications. In a "Mil-Spec" assault weapon it was necessary to have three (and sometimes four) fire selection positions controlled by the selector lever. These positions are generally; "safe," "auto," and "fire." There are several different words for the three options but generally these three are understandable. A "burst" setting is also often available as well. However in civilian versions of the AR it is only necessary to have a "safe" position and a "fire" position available by rotating the safety selector lever. The multi-position selector used in a Mil-Spec rifle isn't necessary on a civilian AR. All that is necessary in the civilian AR is a two-position safety selector acting as a safety device. (Occasionally a lower receiver will have indicia indicating that the selector can be toggled to "auto" however this is largely cosmetic as "auto" is not available on civilian ARs sold in the last two decades in the United States.)

It was not until the inventor did offer the sliding safety selector that a sliding safety selector would work in a semi-automatic rifle that anyone saw its usefulness in the AR market. This is the kind of invention where everyone who first sees a sliding safety selector first says that the concept is old and then goes on to say that they wished they had the insight to apply the sliding safety selector to an AR or similar semi-automatic lower receiver. Nobody offers a sliding safety device for an AR lower receiver except the inventor hereof. In a recent publication of "Guns and Ammo—AR-15" (blue cover with the word "bravo" in yellow, no date, copyright 2015) a magazine format publication containing articles and advertisements pertaining to the AR-15 of more than 150 pages, every single AR lower receiver where the selective fire lever was visible showed only the rotating style of selector. Not one of the many AR rifles or rifle components showed anything but a rotating selector or safety device.

The sliding safety selector presented here is like no other selective fire selector or safety device used on an AR. This sliding safety selector is very fast to actuate from "safe" to "fire" and "fire" to "safe" and doesn't require a visual confirmation by a shooter that the safety is either "on" or "off." The sliding safety selector can be tactilely sensed even while the shooter is looking through the sights of his or her AR. As many civilian AR shooters flip the rotating safety selector to "safe" after only a few shots, it is advantageous to be able to quickly toggle the safety selector from "fire" to "safe" and back again.

Applicant believes that the material incorporated above is "non-essential" in accordance with 37 CFR 1.57, because it is referred to for purposes of indicating the background of the invention or illustrating the state of the art. However, if the Examiner believes that any of the above-incorporated material constitutes "essential material" within the meaning of 37 CFR 1.57(c)(1)-(3), applicants will amend the specification to expressly recite the essential material that is incorporated by reference as allowed by the applicable rules.

BRIEF SUMMARY OF THE INVENTION

The present invention provides a device that is totally different from any safety selector used in semi-automatic rifles such as, but not limited to, the AR-15 style or type rifles. In all modern civilian AR type rifles the safety selector is always a rotating device that is rotated approximately ninety degrees from a "lock" ("safe") to "fire" position corresponding to safety selector being on ("lock" or "safe") to the safety device or selector being off ("fire" or "semi").

One object of this invention is to provide a safety selector for use in AR type rifles.

An advantage of this invention is that this sliding safety selector can be retrofitted to an existing AR to replace the rotating style safety selector with this push type or sliding safety selector.

It is also an advantage to this invention in that it can be installed at the manufacturing facility of the AR lower receiver manufacturer without the need for retooling of the lower receiver. Thus there are no added machining costs for manufacturers to incorporate the sliding safety selector in their lower receivers.

Another advantage is that a person or persons assembling an AR from component parts can fit this device in the lower receiver that she or he is using for the AR assembly without a need to have a special lower receiver or special machining to accommodate this sliding safety selector.

It is also an object to provide a method enabling a person to replace a conventional safety selector used on an "AR" with this more user-friendly sliding safety selector.

It is also an advantage of this sliding safety selector for use with an AR that the safety selector can be moved from the off position to the on position very quickly without the need of visual confirmation.

A further advantage is that this sliding safety selector is easy to actuate while wearing gloves.

On more advantage of this sliding selector is that it may be operated more easily by individuals that have finger or hand special considerations.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. §112, ¶6. Thus, the use of the words "function," "means" or "step" in the Detailed Description or Description of the Drawings or claims is not intended to somehow indicate a desire to invoke the special provisions of 35 U.S.C. §112, ¶6, to define the invention. To the contrary, if the provisions of 35 U.S.C. §112, ¶6 are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. §112, ¶6. Moreover, even if the provisions of 35 U.S.C. §112, ¶6 are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

BRIEF DESCRIPTION OF THE DRAWING

A more complete understanding of the present invention may be derived by referring to the detailed description when considered in connection with the drawing figures wherein.

Elements and acts depicted in the figure are illustrated for simplicity. They are presented to illustrate the invention to assist in an understanding thereof. The figure is not necessarily been rendered according to any particular sequence, size, scale or embodiment.

DETAILED DESCRIPTION OF THE INVENTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the invention is not limited to the examples that are described below.

As mentioned above, this invention has to do with AR style rifles and particularly the safety selector carried in the lower receiver of an AR style rifle. This type of lower receiver has a pair of aligned holes or apertures, one on each side to the lower receiver. These holes accommodate the safety selector on all AR style rifles. The placement of the holes is to position the safety selector slightly above the tail extension or trigger tail (also known as the top surface of the rear portion of the trigger) of the AR style trigger. This invention is carried in those two holes and has its center section, including the "safe shelf" or smaller diameter section of the second end of the sliding safety device that restrains the trigger from firing the AR style rifle. The sliding safety selector is thus positioned slightly above the trigger tail in just the same position as a lever or rotary safety selector.

Figure 1:
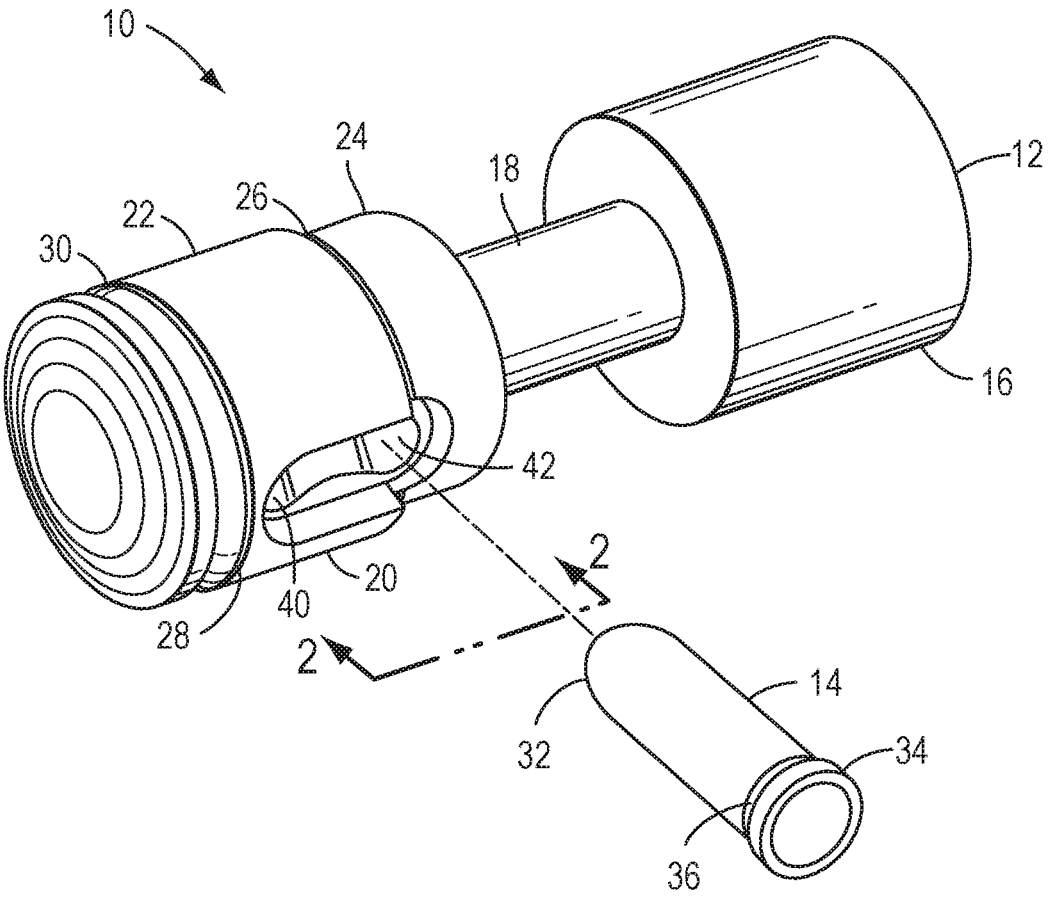
FIG. 1 shows an orthographic projection of a sliding safety selector and the detent pin used with the safety selector.
Figure 2:
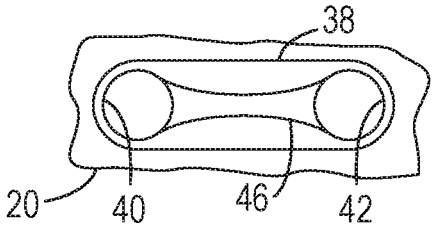
FIG. 2 is a portion of the main body of the selector showing the longitudinal chamber and associated elements.

Turning to FIGS. 1 and 2 there is shown a projected view of the sliding safety selector and the detent pin used with the sliding safety selector. These two components are all that are needed to replace a rotating safety selector in a civilian AR lower receiver.

The sliding safety selector 12 includes a first end 16, which is cylindrical in cross section and makes up about a third of the length of the sliding safety selector. The diameter of these elements are selected to be compatible with the mil-spec dimensions of the holes in the lower receiver that accommodates them. For instance, they can have a diameter range of 0.375+/−0.010 inches, in one embodiment they are 0.371 inches in diameter. A connecting rod 18 extends from the first end 16 to a second end 20. In a preferred embodiment the connecting rod is round in cross-section but can have any cross-sectional shape that acts as a connector between the two ends of the sliding safety connector. The second end 20 of the sliding safety connector has a body portion 22 that is the same diameter as the diameter of the first end 16. A smaller diameter section 24, of about 0.325+/−0.010 inches, in one embodiment the measurement is 0.322 inches, is formed on the sliding safety selector inboard of the body portion 22 of the second end 20 and is also connected to the connecting rod 18. There is a small circumferential groove 26 formed in the smaller diameter section 24 at the juncture of the smaller diameter section 24 and the body portion 22 of the second end 20 of the sliding safety selector 12.

Near the top of the outboard end of the body portion 22 there is a second circumferential groove 28. Carried in this groove 28 is a highly visible colored O-ring 30, in one example this O-ring would be red. The O-ring 30 is used to display that the sliding safety selector is positioned in the "fire" position and the AR can be fired. If the O-ring 30 isn't visible when the sliding safety selector is slid into a bore of a lower receiver of the AR the rifle is in the "safe" mode. Since the red O-ring is nested in the receiving bore of the lower receiver, the safety is "on" and the rifle can't be fired.

The red O-ring can be any color that helps show that the sliding safety is in the fire position. Furthermore, the end of the body portion can be painted or anodized to be distinctive. For night use it would be helpful to have a highly visible finish on the end of the body portion, such as, but not limited to, a glowing or phosphorescent coating.

In another embodiment of the invention no circumferential groove is provided but the body portion of the second end is treated to be highly visible.

The ends of the sliding safety selector may have a pattern of concentric ridges or grooves formed on the ends of one or both of the first and second ends. Alternatively other friction enhancing surface treatments, such as but not limited to, graphic indicia.

A detent pin 14 restrains the movement of the sliding safety selector through the bores of the lower receiver. Bores in the lower receiver portion of AR style rifles are formed transverse to the major axis of the lower receiver. These bores are of a standard size and will accommodate the sliding safety selector 12 presented here. The intent of the inventor is to present a sliding safety selector that is a direct replacement of the rotating safety selector used on all modern civilian AR style rifles. Thus no machining of the lower receiver is necessary to fit the sliding safety selector in place of a rotating safety selector removed from an assembled civilian AR style rifle.

The detent pin 14 has one end 32 that is generally rounded and a second end 34 with a diameter slightly larger then the diameter of the longitudinal body 44 of the detent pin 14. There is a circumferential groove 36 between the body of the detent pin and the slightly larger diameter at the non-rounded end of the detent pin.

The detent pin 14 is carried in and is spring loaded in a preexisting bore in the lower receive previously used to contain a similar detent pin used with the rotating safety selector. The pin 14 of the sliding safety selector simply replaces a similar pin used with the rotating style safety selector that is being replaced with the sliding safety selector 12.

The rounded end of the detent pin 14 is spring loaded (spring not shown, it is one of the two dozen or so parts of a conventional AR style lower receiver and is the same spring and same spring mounting location as used in an AR style lower receiver with a rotating safety selector) to detent the sliding safety selector as the rounded end 32 of the pin 14 interfaces with a machined slot or longitudinal chamber 38 formed in the body portion of the second end of the sliding safety device. As best seen in FIG. 1, the base of this longitudinal chamber 38 has first 40 and second depressions 42, or pin receiving dimples, to accommodate the rounded end 32 of the pin 14 when the pin 14 is in one or the other of two displacements, either in the "fire" position or in the "safe" position. Between the first 40 and second 42 depressions the floor of the longitudinal chamber there is an incline 46 that extends upwardly from the edge of the first depression 40 toward the second depression 42 and when the incline 46 is midway between the first depression 40 and the second depression 42 the incline extends downwardly toward the second depression 42. The sides of the longitudinal chamber 38 are not parallel but have contours extending toward each other with the closest point between the sides of the longitudinal chamber proximate the highest point of the upward and downward sloping incline between the first and second depressions. This is a result of the tool, normally a ball end mill, used to form the depressions being moved away from the major axis of the sliding safety selector after forming the first depression and cutting the longitudinal groove 38 as the ball mill tool moves toward the location of the second depression on a downward direction. The incline thus formed assists in allowing the rounded end of the detent pin to move smoothly from one depression to the other depression.

The generally flat ends of the cylinders 16 and 20 may have a series concentric circles formed on the ends of the cylinders as shown in FIG. 1.

Once the sliding safety selector, generally 10, has been installed in the lower receiver of an AR style rifle the portion of the selector between the two ends 12 and 14 will contact the upper portion of the trigger assembly when the sliding safety selector is in the "safe" position. When the selector is in the safe position the end of the top surface of trigger will ride on the smaller diameter 24 of the selector. In this position the rifle can't be fired.

To allow the safety selector 10 to be in position to allow the rifle to fire, the sliding safety selector 10 will be urged by the operator pressing on the exposed end surface of the first end of 16 of the sliding safety selector to the fire position. In this position the second end 22 of the sliding safety selector 10 will project outwardly from the side of lower receiver. The red O-ring will be exposed indicating that the sliding safety selector 10 is no longer in contact with the extension on the trigger thus allowing the weapon to be fire. In this position the trigger extension will be off the smaller diameter 24 section of the selector and will be adjacent the connecting rod 18 but not in contact with it.

Installing the sliding safety selector in the lower receiver of an AR style rifle is uncomplicated. Of course the rifle has to be cleared to make sure there is no ammo in the rifle so it is not fired accidently. First the rotating safety selector has to be removed. The lever or rotating safety selector is simply pushed out of the lower after the retaining detent pin is removed and the new sliding safety selector is pushed into place and the detent pin is replaced. The selector detent pin is urged into contact with the selector by a selector spring held in place under the pistol grip. The pistol grip is attached to the lower by a pistol grip screw and a locking washer. The pistol grip is removed to get access to the selector spring and the selector detent. They will both just fall out of the lower receiver with the pistol grip removed. After the selector detent is removed the hammer is cocked back to the half-cocked position and the selector can be removed.

Installation of the sliding safety selector is basically the reverse of the removal process. With the rifle's hammer in the half-cocked position the sliding selector is pushed through the lower receiver from either the left or right until it is in the fire position with the red O-ring showing on the right side of the lower. The selector detent is positioned in its bore and the selector spring is positioned against the outboard end of the selector detent pin. The sliding safety selector is rotated in the selector apertures on each side of the lower receiver until the selector pin engages the slot or longitudinal chamber in the sliding selector. At this point the pistol grip can be reinstalled and secured using the pistol grip screw and washer to retain the selector spring in compression between the pistol grip and the outboard end of the selector pin. The sliding safety selector is now tested to make sure it locks the hammer in "safe" when the sliding safety selector is pushed to the safe location with the red O-ring hidden in the lower receiver.

In summary the invention comprises a component for an AR style lower receiver. The component is a sliding safety selector that replaces the lever operated rotating safety selector in the lower receiver of AR style rifle. No AR style rifle uses a sliding safety selector. As far as the inventor knows all AR style rifles use a rotating safety selector.

In further summary the invention is a sliding safety selector for use in a lower receiver of an AR style semi-automatic rifle the sliding safety selector includes at least a cylindrical first end with an inboard surface and an outboard surface. A cylindrical connecting rod is attached to the inboard surface of the first end. The connecting rod has a major axis, a first end, and a second end. The connecting rod is carried on the inboard surface of the cylindrical first end, the connecting rod aligned with the major axis of the cylindrical connecting rod. A cylindrical second end is connected to the second end of the connecting rod. This cylindrical second end has a safety selector shelf of a first diameter and a body section having diameter larger than then diameter of the safety selector shelf. The cylindrical second end also has an outboard surface. A longitudinal chamber is formed in the safety selector shelf and the body section of the cylindrical second end. This chamber extends longitudinally along the cylindrical second end of the sliding safety selector. There are also first and second detent recesses formed in the longitudinal chamber.

An incline is formed, must easily using a ball end mill, between the first and second detent recesses. The incline has an upward slope portion and a downward slope portion.

The cylindrical first end of the sliding safety selector has a length greater than its diameter. Similarly the body portion of the second end of the selector has a length greater than the diameter of the cylindrical second end.

It is desirable to have a circumferential groove formed in the body portion of the cylindrical second end of the sliding safety selector. This circumferential groove can be given a highly visible surface treatment. Alternatively, an O-ring, having a highly visible color, such as red, can be carried in the circumferential groove.

An alternative to the circumferential groove, although it can be used as well, is to have the body portion of the cylindrical second end of the sliding safety selector comprising a highly visible surface.

In one embodiment of the invention a narrow circumferential groove is formed in the safety shelf immediately inboard of the body portion of the second end where the body portion of the second end attaches to the safety shelf.

As this device is generally interfacing with a human hand or finger it is advantageous to provide the sliding safety selector with friction-improving surfaces at each end of the device. This can be a series of concentric grooves, or in one embodiment, a graphic indicia, such as a company logo.

The sliding safety selector has a two depressions or dimples that are provided to receive a detent pin. The detent pin is engageable with the first and second detent recesses of the longitudinal chamber. The detent pin will also track along an in the inclined recess formed between the two detents in the longitudinal chamber of the main body. The pin is always, (when properly installed) in spring loaded seated contact with one of the depressions and when not seated in a depression the pin is contained in the longitudinal chamber. This prevents the main body of the sliding safety selector from sliding out of the host AR style lower receiver.

While the invention is described herein in terms of preferred embodiments and generally associated methods, the inventor contemplates that alterations and permutations of the preferred embodiments and methods will become apparent to those skilled in the art upon a reading of the specification and a study of the drawings.

Accordingly, neither the above description of preferred exemplary embodiments nor the abstract defines or constrains the invention. Rather, the issued claims variously define the invention. Each variation of the invention is limited only by the recited limitations of its respective claim, and equivalents thereof, without limitation by other terms not present in the claim.

The invention claimed is:

1. A sliding safety selector for use in a lower receiver of a semi-automatic rifle, the semi-automatic rifle based on an AR-15 semi-automatic rifle platform, the sliding safety selector comprising:

a cylindrical first end having an inboard surface;

a cylindrical connecting rod having a first end and a second end, the cylindrical connecting rod carried on the inboard surface of the cylindrical first end;

a cylindrical second end of the sliding safety selector connected to the second end of the cylindrical connecting rod, the cylindrical second end having a safety selector shelf of a first diameter and a body section having diameter larger than the diameter of the safety selector shelf;

a longitudinal chamber formed in the safety selector shelf and the body section of the cylindrical second end, the longitudinal chamber extending longitudinally along the cylindrical second end of the sliding safety selector;

first and second detent recesses formed in the longitudinal chamber.

2. The invention in accordance with claim 1 comprising an incline formed between the first and second detent recesses.

3. The invention in accordance with claim 2 wherein the incline has an upward slope portion and a downward slope portion.

4. The invention in accordance with claim 3 wherein the cylindrical first end has a length greater than its diameter.

5. The invention in accordance with claim 4 wherein the body portion of the second end has a length greater than the diameter of the cylindrical second end.

6. The invention in accordance with claim 1 comprising a circumferential groove formed in the body portion of the cylindrical second end of the sliding safety selector.

7. The invention in accordance with claim 6 wherein the circumferential groove is given a highly visible surface treatment.

8. The invention in accordance with claim 6 wherein the circumferential groove contains an O-ring.

9. The invention in accordance with claim 8 wherein the O-ring is a highly visible color.

10. The invention in accordance with claim 8 wherein the O-ring is red.

11. The invention in accordance with claim 6 wherein a narrow circumferential groove is formed in the safety shelf immediately inboard of the body portion of the second end where the body portion of the second end attaches to the safety shelf.

12. The invention in accordance with claim 1 wherein the body portion of the cylindrical second end of the sliding safety selector comprises a highly visible surface.

13. The invention in accordance with claim 1 comprising friction-improving surfaces at each end of the device.

14. The invention in accordance with claim 13 wherein the friction-improving surface comprises a series of concentric grooves.

15. The invention in accordance with claim 13 wherein the friction-improving surface comprises graphic indicia.

16. The invention in accordance with claim 1 further comprising a detent pin engageable with the first and second detent recesses of the longitudinal chamber.

17. A sliding safety selector for use in a lower receiver of a semi-automatic rifle, the semi-automatic rifle based on an AR-15 semi-automatic rifle platform, the sliding safety selector comprising:

a cylindrical first end having an inboard surface;

a cylindrical connecting rod having a major axis and having a first end and a second end, the connecting rod carried on the inboard surface of the cylindrical first end a cylindrical second end of the sliding safety selector connected to the second end of the cylindrical connecting rod, the cylindrical second end having a safety selector shelf of a first diameter and a body section having diameter larger than the diameter of the safety selector shelf;

a longitudinal chamber formed in the safety selector shelf and the body section of the cylindrical second end, the longitudinal chamber extending longitudinally along the cylindrical second end of the sliding safety selector;

first and second detent recesses formed in the longitudinal chamber;

an incline formed between the first and second detent recesses wherein the incline has an upward slope portion and a downward slope portion.

18. The invention in accordance with claim 17 further comprising a detent pin engageable with the first and second detent recesses of the longitudinal chamber.

19. A method of replacing a rotating safety selector in a semi-automatic rifle, the semi-automatic rifle based on an AR-15 semi-automatic rifle platform comprising the acts of:

cocking back a hammer of the semi-automatic rifle to the half-cocked position;

removing the rotating safety selector from the semi-automatic rifle by removing a pistol grip of the semi-automatic rifle and removing a detent spring and removing a retaining detent pin allowing the rotating safety selector to be pushed out of contact with the semi-automatic rifle;

positioning a sliding safety selector of claim 1, the sliding safety selector comprising a slot in the sliding safety selector, into place in the semi-automatic rifle;

replacing the detent pin and the detent spring to retain the sliding safety selector of claim 1 in place in the semi-automatic rifle;

rotating the sliding safety selector of claim 1 in apertures on each side of the semi-automatic rifle until the detent pin engages the slot in the sliding safety selector;

replacing the pistol grip on the semi-automatic rifle to retain the detent spring and detent pin in the semi-automatic rifle.

* * * * *